US006295785B1

(12) United States Patent
Herrmann

(10) Patent No.: US 6,295,785 B1
(45) Date of Patent: Oct. 2, 2001

(54) GEODESIC DOME AND METHOD OF CONSTRUCTING SAME

(76) Inventor: Robert M. Herrmann, 5202 Moceri La., Grand Blanc, MI (US) 48439

( * ) Notice: Subject to any disclaimer, the term of this patent is extended or adjusted under 35 U.S.C. 154(b) by 0 days.

(21) Appl. No.: 09/273,830

(22) Filed: Mar. 22, 1999

(51) Int. Cl.[7] ..... E04B 1/32

(52) U.S. Cl. ..... 52/745.08; 52/81.3; 52/81.4; 52/639; 52/652.1; 52/745.07; 52/DIG. 10

(58) Field of Search ..... 52/81.1–81.4, 52/245, 236.1, 236.2, 639, 648.1, 653.1, 655.1, 655.2, 745.05–745.08, DIG. 10, 652.1

(56) References Cited

U.S. PATENT DOCUMENTS

| | | | | |
|---|---|---|---|---|
| 3,392,495 | * | 7/1968 | Ahern et al. . | |
| 4,026,078 | * | 5/1977 | Ahern et al. | 52/81 |
| 4,092,810 | * | 6/1978 | Summer | 52/81 |
| 4,160,345 | * | 7/1979 | Nalick | 52/81 |
| 4,187,613 | * | 2/1980 | Ivers et al. | 33/174 |
| 4,241,550 | * | 12/1980 | Sumner | 52/81 |
| 4,703,594 | * | 11/1987 | Reber | 52/81 |
| 4,729,197 | * | 3/1988 | Miller | 52/81 |
| 5,452,555 | * | 9/1995 | Lee | 52/584.1 |
| 5,704,169 | * | 1/1998 | Richter | 52/81.2 |
| 5,907,931 | * | 6/1999 | Sun | 52/81.4 |

* cited by examiner

*Primary Examiner*—Carl D. Friedman
*Assistant Examiner*—Yvonne M. Horton
(74) *Attorney, Agent, or Firm*—Plunkett & Cooney, P.C; Arnold S. Weintraub; Luis Miguel Acosta

(57) ABSTRACT

A geodesic dome is created by the steps of: (a) generating a mathematical model of a geodesic dome, (b) fabricating components with which to form a geodesic dome according to the model; and (c) fastening the components to each other according to the model. In the model, M base triangles are generated in a closed three-dimensional shape. M is at, least four, with eight being preferred and the preferred closed three-dimensional shape being a regular octahedron. The closed three-dimensional shape has a center point from which each vertex of each of the base triangles is equidistant, this distance being a geodesic radius. Each leg of each base triangle is then subdivided into N segments of equal length, N being at least two, with eight being preferred, thus defining N+1 segment endpoints or intersections along each leg. A line is then generated between each intersection and two corresponding intersections, thus defining $N^2$ smaller triangles per base triangle. A line is then generated from each vertex of each of the smaller triangles to the center point. Each line thus generated is then extended until it is the same length as the geodesic radius. The endpoint of each extended line is then connected to each endpoint adjacent to the endpoint, thus generating a substantially curved surface formed of $N^2$*M triangles, the substantially curved surface defining a mathematical model of a geodesic dome. Struts or panels ate fastened together in the pattern of the substantially curved surface to form the geodesic dome.

12 Claims, 6 Drawing Sheets

GEODESIC DOME AND METHOD OF CONSTRUCTING SAME

CROSS-REFERENCE TO RELATED APPLICATION

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to building structures. More particularly, the present invention relates to geodesic domes. Even more particularly, the present invention relates to a method of constructing a geodesic dome based on an octahedron.

2. Prior Art

The prior art has taught geodesic domes in which the pattern of construction is based on closed three-dimensional shapes other than an octahedron. For example, in U.S. Pat. Nos. 2,682,235; 2,914,074; and 3,203,144, Fuller teaches a geodesic dome based on an icosahedron. In U.S. Pat. No. 3,197,927, Fuller teaches a geodesic dome based on a dodecahedron or a tricontahedron in addition to an icosahedron.

Yacoe, U.S. Pat. No. 4,679,361, teaches a polyhedral structure that approximates a sphere. The polyhedral structure has a plurality of polygonal faces, at least two of which are regular polygons and at least half the remainder of which are non-equilateral hexagons or pentagons. Each vertex of the polyhedron is a junction of three or four polygonal edges. Each polygonal edge is tangent to the approximated sphere at one point.

Bergman, U.S. Pat. No. 4,719,72.6, teaches a construction system for forming icosahedral structures from a series of shells. Each shell utilizes a plurality of octahedrons and tetrahedrons.

Lalvani, U.S. Pat. No. 4,723,382, teaches a construction system for forming icosahedral structures. The system utilizes four triangles of varying sizes and shapes and six parallelograms of varying sizes and shapes that are combined to form tetrahedral, octahedral, half-octahedral, truncated tetrahedral, cuboctahedral, truncated octahedral, rhombohedral, and parallelepiped members. These members are then combined to form the icosahedral structure.

Reilly, U.S. Pat. No. 5,411,047, teaches a tent formed of a skin draped over a support structure. The support structure is formed of a plurality of elongated members, such as pipes or the like, that join to form a plurality of patterns. These patterns are based on four-, six-, or eight-sided geodetic support structures that have common apical coupling points.

It is to be appreciated that none of these references teaches a geodesic dome based on an octahedron. A geodesic dome based on an octahedron is desirable because it is easier to divide into halves and other fractional sections, and thus to construct fractional geodesic domes from, than is a geodesic dome based on an icosahedron, a dodecahedron, a tricontahedron, or any other three-dimensional shape. The present invention, as detailed hereinbelow, presents such an octahedron-based geodesic dome.

BRIEF SUMMARY OF THE INVENTION

As used herein, the term "geodesic dome" refers to a structure approximating a sphere or a portion thereof, such as a hemisphere, a quarter sphere, or another portion of a sphere. The term "full geodesic dome" refers to a geodesic dome that specifically approximates a sphere, rather than approximating a portion thereof.

The present invention provides a method of constructing a geodesic dome and a geodesic dome constructed according to the method. Generally, the method comprises the steps of:

(a) generating a mathematical model of a geodesic dome, the method comprising the steps of:
  (1) generating M base triangles in the form of a closed three-dimensional shape, each base triangle existing in a plane, M being a positive integer greater than three;
  (2) defining a center point within the closed three-dimensional shape, the center point being equidistant from each of the vertices of each of the base triangles;
  (3) defining a geodesic radius as the distance between the center point and any of the vertices of any of the base triangles;
  (4) subdividing each leg of each of the base triangles into N segments of equal length, N being a positive integer greater than one, thus defining N+1 intersections along each leg of each of the base triangles;
  (5) connecting each intersection defined in step (4) to two corresponding intersections within the same base triangle, thus generating $N^2$ smaller triangles within each base triangle;
  (6) generating an interior line between each vertex of each of the smaller triangles and the center point;
  (7) extending each of the interior lines generated in step (6) through the plane of the base triangle in which the smaller triangle exists until each of the interior lines as extended outside the base triangle is the same length as the geodesic radius, each extended line terminating in an endpoint opposite the center point; and
  (8) connecting each endpoint defined in step (7) to each other endpoint generated in step (7) adjacent to the line end by an exterior line, thus generating a substantially curved surface comprising $N^2*M$ triangles, the substantially curved surface defining a mathematical model of a geodesic dome;

(b) fabricating a plurality of components with which to form a geodesic dome according to the model; and (c) fastening the components to each other according to the model.

Preferably, M=8, N=8, the base triangles are equilateral triangles, and the three-dimensional shape is a regular octahedron. Thus, eight base equilateral triangles are generated in the first step; each leg of each base triangle is divided into eight segments with nine intersections in the fourth step; 64 smaller triangles per base triangle are generated in the fifth step; the geodesic dome has 512 triangles on the surface thereof; etc. The higher N is, the more closely the geodesic dome created by this method approximates a sphere or a portion thereof.

For a more complete understanding of the present invention, reference is made to the following detailed description and accompanying drawings. In the drawings, like reference characters refer to like parts through the several views, in which:

DETAILED DESCRIPTION OF THE INVENTION

As used herein, and as noted hereinabove, the term "geodesic dome" refers to a structure approximating a sphere or a portion thereof, such as a hemisphere, a quarter sphere, or another portion of a sphere. The term "full geodesic dome" refers to a geodesic dome that specifically approximates a sphere, rather than approximating a portion thereof.

As noted hereinabove, the present invention provides a method of constructing a geodesic dome and a geodesic dome constructed according to the method. Generally, the method comprises the steps of:

(a) generating a mathematical model of a geodesic dome, the method comprising the steps of:

(1) generating M base triangles in the form of a closed three-dimensional shape, each base triangle existing in a plane, M being a positive integer greater than three;

(2) defining a center point within the closed three-dimensional shape, the center point being equidistant from each of the vertices of each of the base triangles;

(3) defining a geodesic radius as the distance between the center point and any of the vertices of any of the base triangles;

(4) subdividing each leg of each of the base triangles into N segments of equal length, N being a positive integer greater than one, thus defining N+1 intersections along each leg of each of the base triangles;

(5) connecting each intersection defined in step (4) to two corresponding intersections within the same base triangle, thus generating $N^2$ smaller triangles within each base triangle;

(6) projecting an interior line between each vertex of each of the smaller triangles and the center point;

(7) extending each of the interior lines generated in step (6) through the plane of the base triangle in which the smaller triangle exists until each of the interior lines as extended outside the base triangle is the same length as the geodesic radius, each extended line terminating in an endpoint opposite the center point; and (8) connecting each endpoint defined in step (7) to each other endpoint generated in step (7) adjacent to the line end by an exterior line, thus generating a substantially curved surface comprising $N^2*M$ triangles, the substantially curved surface defining a mathematical model of a geodesic dome;

(b) fabricating a plurality of components with which to form a geodesic dome according to the model; and (c) fastening the components to each other according to the model.

Initially, a mathematical model of a geodesic dome is generated by the method hereof. Following generation of the mathematical model, a geodesic dome based on the model is constructed using, preferably, conventional building materials and techniques.

Figure 1:
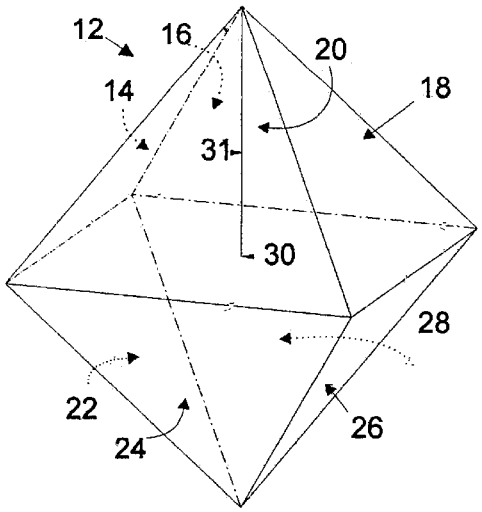
FIG. 1 is a perspective view of an octahedron comprising eight base triangles in accordance with the mathematical model hereof, illustrating the first three steps.

As noted, initially, the mathematical model of a geodesic dome is generated. Eight steps are involved in generating the mathematical model. The first step in generating the mathematical model is to generate M triangles in a closed three-dimensional shape 11, M being a positive integer greater than three, i.e. four or larger. Preferably, M is eight and the triangles are equilateral triangles, resulting in a regular octahedron 12, as shown in FIG. 1. The octahedron 12 is used herein for purposes of brevity and clarity; however, it is to be understood that other closed three-dimensional shapes, such as hexahedrons, work also.

The octahedron 12 includes eight base equilateral triangles 14, 16, 18, 20, 22, 24, 26, 28, respectively, arranged as two four-sided pyramids with opposed apices, as shown in FIG. 1.

The second step in generating the mathematical model is to define a center point within the octahedron 12 equidistant from each of the vertices of each of the base triangles. Here, the center point is denoted at 30.

The third step in-generating the mathematical model is to define a "geodesic radius". The geodesic radius is the distance between the center point 30 and any of the vertices of any of the base triangles. Here, the geodesic radius is denoted at 31.

To proceed in the mathematical model from the octahedron 12 to a modelled geodesic dome, several steps must be performed upon each of the base triangles. In the interests of brevity and clarity, one of the base triangles, the triangle 14, will be used as an example herein. The triangle 14 has three legs 32, 34, 36 and three vertices 33, 35, and 37. As shown, the vertex 33 is between the legs 32 and 34, the vertex 35 is between the legs 34 and 36, and the vertex 37 is between the legs 36 and 32. The vertices 33, 35, and 37 are equidistant from the center point 30, the distance between each of the vertices 33, 35, 37 and the center point 30 being the geodesic radius 31, as detailed hereinabove.

Figure 2:
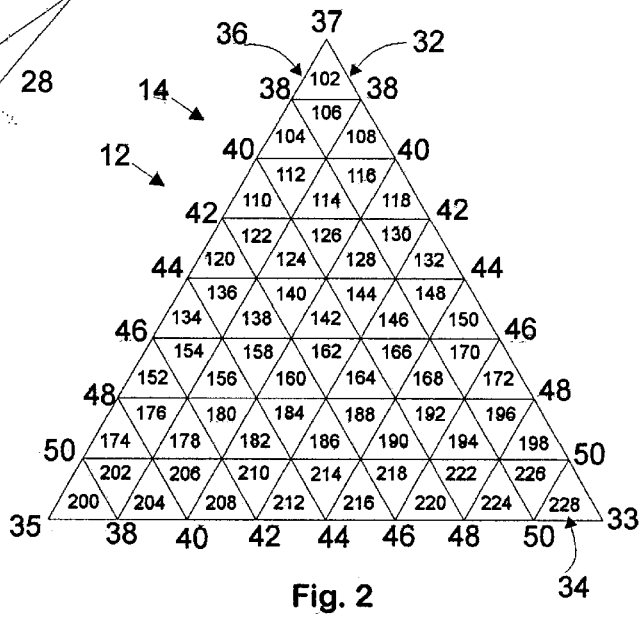
FIG. 2 is a front view of a base triangle with legs segmented and connecting lines in accordance with the mathematical model hereof, illustrating the fourth and fifth steps.

The fourth step in generating the mathematical model is to subdivide each leg 32, 34, 36 into N segments of equal length, N being a positive integer greater than one. For convenience, N is called the "frequency." In FIG. 2, a value of eight is used for the frequency, though it is to be understood that any positive integer greater than one may be used for N. The higher the frequency is, the more closely the model, and thus a geodesic dome created according to the model, will approximate a sphere or a portion thereof. With the frequency being eight, as shown in FIG. 2, this fourth step results in segment ends or intersections 37, 38, 40, 42, 44, 46, 48, 50, 33 along the leg 32; segment ends or intersections 35, 38', 40', 42', 44', 46', 48', 50', 33 along the leg 34; and segment ends or intersections 37, 38", 40", 42", 44", 46", 48", 50", 35 along the leg 36.

The fifth step in generating the mathematical model is to connect each of the intersections 38, 40, 42, 44, 46, 48, 50 with two corresponding intersections 38', 40', 42', 44', 46', 48', 50' and 38", 40", 42", 44", 46", 48", 50" by connecting lines. Correspondence between intersections is given by relative position from each intersection to each of the vertices at the termini of the leg containing the intersection. For each intersection, the sum of the two relative positions is, necessarily, equal to the frequency N. As an example, in FIG. 2, where the frequency is eight, the intersection 38 is in the first relative position from the vertex 37 and the seventh relative position from the vertex 33, the vertices 37 and 33 being the termini of the leg 32 containing the intersection 38; these relative positions, i.e. one and seven, sum to eight, the frequency shown in FIG. 2. The corresponding intersections for the intersection 38 are thus the first intersection from the vertex 37 on the leg 36, i.e. the intersection 38", and the seventh intersection from the vertex 33 on the leg 34, i.e. the intersection 38', respectively. The connecting lines generated in this fifth step cooperate with the legs of the base triangles to form $N^2$ smaller triangles (denoted as 102 through 228 in FIG. 2) per base triangle, with 1+2+3+. . . +(N+1) vertices of the smaller triangles per base triangle.

Figure 3:
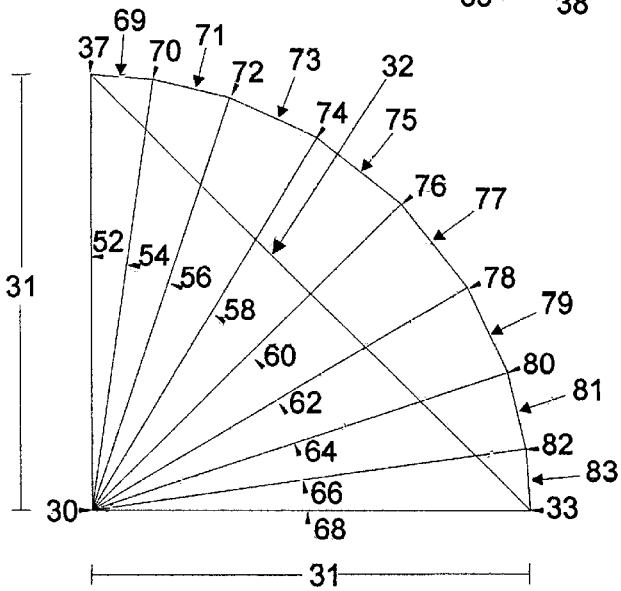
FIG. 3 is a front view of a segmented leg of a base triangle with lines projecting from the center point and through the leg in accordance with the mathematical model hereof, illustrating the sixth, seventh, and eighth steps.

The sixth step in generating the mathematical model is to project an interior line between each vertex of each of the smaller triangles and the center point 30. In FIG. 3, the interior lines are denoted at 52, 54, 56, 58, 60, 62, 64, 66, and 68.

The seventh step in generating the mathematical model is to extend each of the interior lines generated in the sixth step until it is the same length as the geodesic radius 31. Each extended line thus generated terminates in an exterior endpoint opposite the center point 30. In FIG. 3, the exterior endpoints are denoted at 37, 70, 72, 74, 76, 78, 80, 82, and 33.

Figure 4:
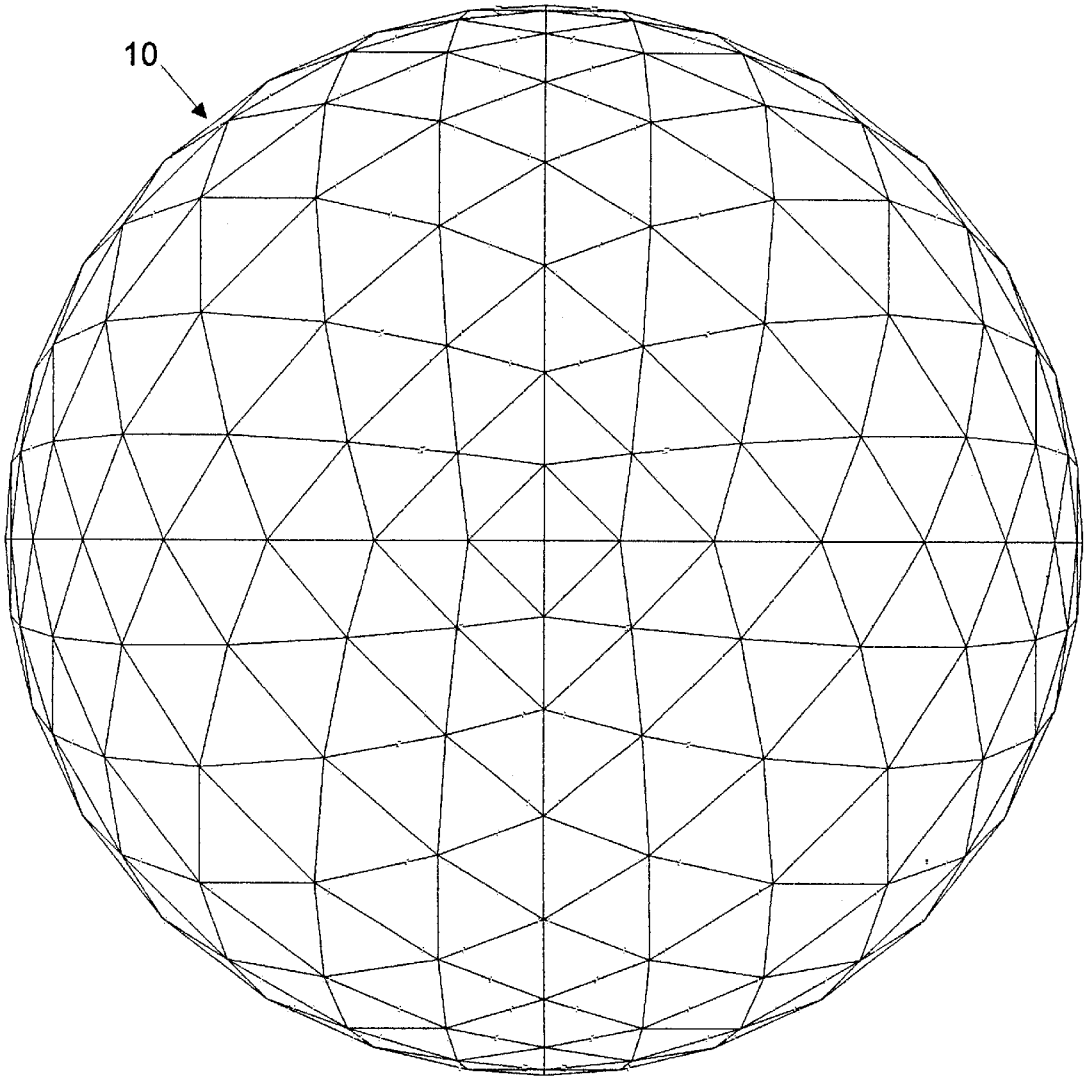
FIG. 4 is a perspective view of a mathematical model of a full geodesic dome created according to the method hereof.
Figure 5:
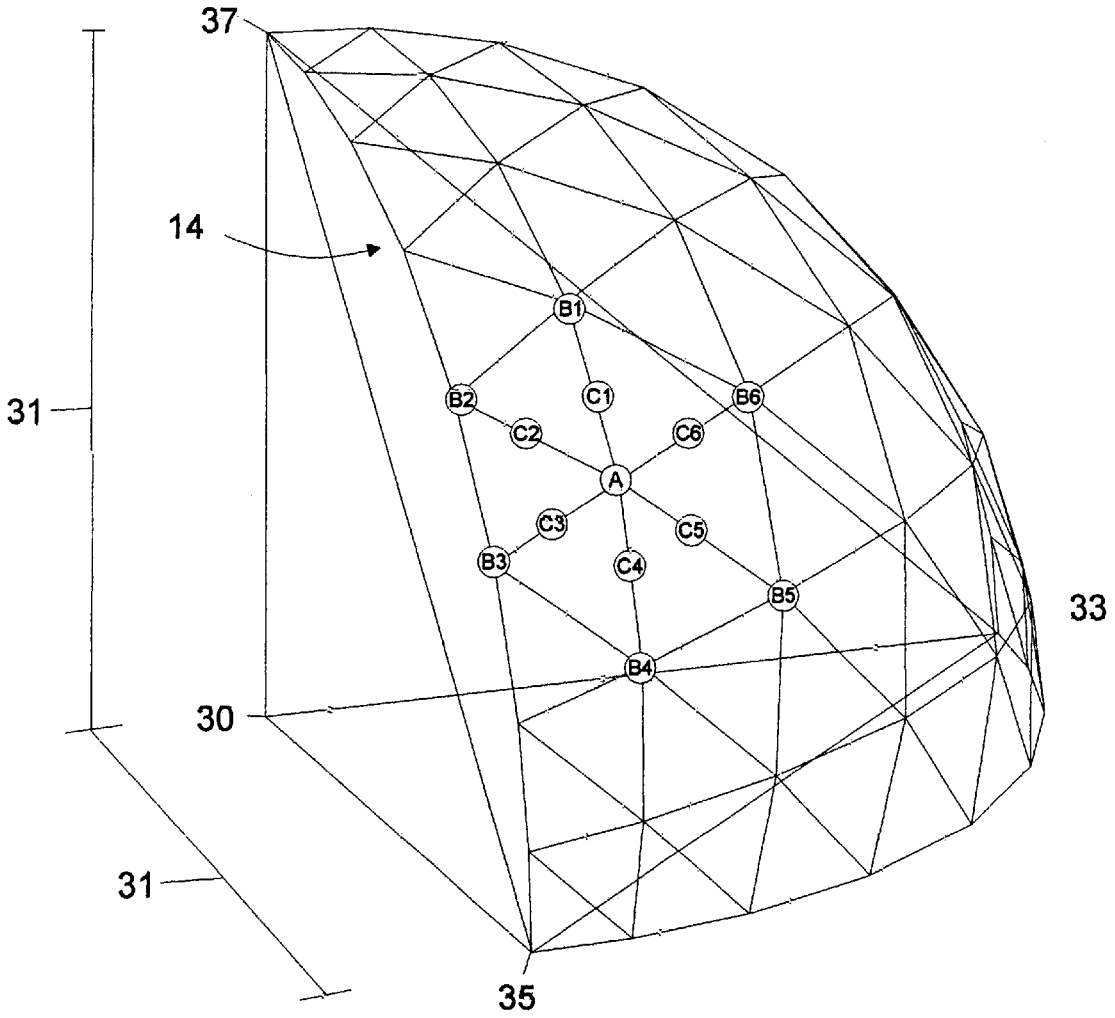
FIG. 5 is a partial perspective view of a mathematical model of one-eighth of a full geodesic dome created according to the method hereof.

The eighth step in generating the mathematical model is to connect each exterior endpoint generated in the seventh step, for instance the exterior endpoint 72, to each other exterior endpoint generated in the seventh step that is adjacent to the exterior endpoint 72 by an exterior line. In FIG. 3, the exterior lines are denoted at 69, 71, 73, 75, 77, 79, 81, and 83. Another example of the result of this eighth step, showing the result for the entire base triangle 14 rather than for just the single leg 32, is shown in FIG. 5. In FIG. 5, the exterior lines for a single exterior endpoint A are further labelled: For the exterior endpoint denoted at A, the adjacent endpoints are denoted at B1, B2, B3, B4, B5, and B6; and the corresponding connecting lines are denoted at C1, C2, C3, C4, C5, and C6, respectively. A further example of the result of this eighth step, showing the result for all eight assembled base triangles, is shown in FIG. 4. As shown in FIG. 4, the exterior lines generated in this eighth step cooperate to define a substantially curved surface 10 made of $N^2$*M triangles, the substantially curved surface defining a mathematical model of a geodesic dome.

The exterior lines generated in the eighth step are not all of the same length. Rather, the lengths of the exterior lines vary symmetrically from one to another based on proximity to a vertex of a base triangle. Exterior lines adjacent to vertices of the base triangles are the same length as each other, and lengths of exterior lines increase with increasing distance from vertices of the base triangles. As an example, in FIG. 3, the exterior lines 69 and 83 are the shortest and are the same length as each other; the exterior lines 71 and 81 are slightly longer than are the exterior lines 69 and 83, and are the same length as each other; the exterior lines 73 and 79 are slightly longer than are the exterior lines 71 and 81, and are the same length as each other; and the exterior lines 75 and 77 are slightly longer than are the exterior lines 73 and 79, and are the same length as each other.

Figure 6:
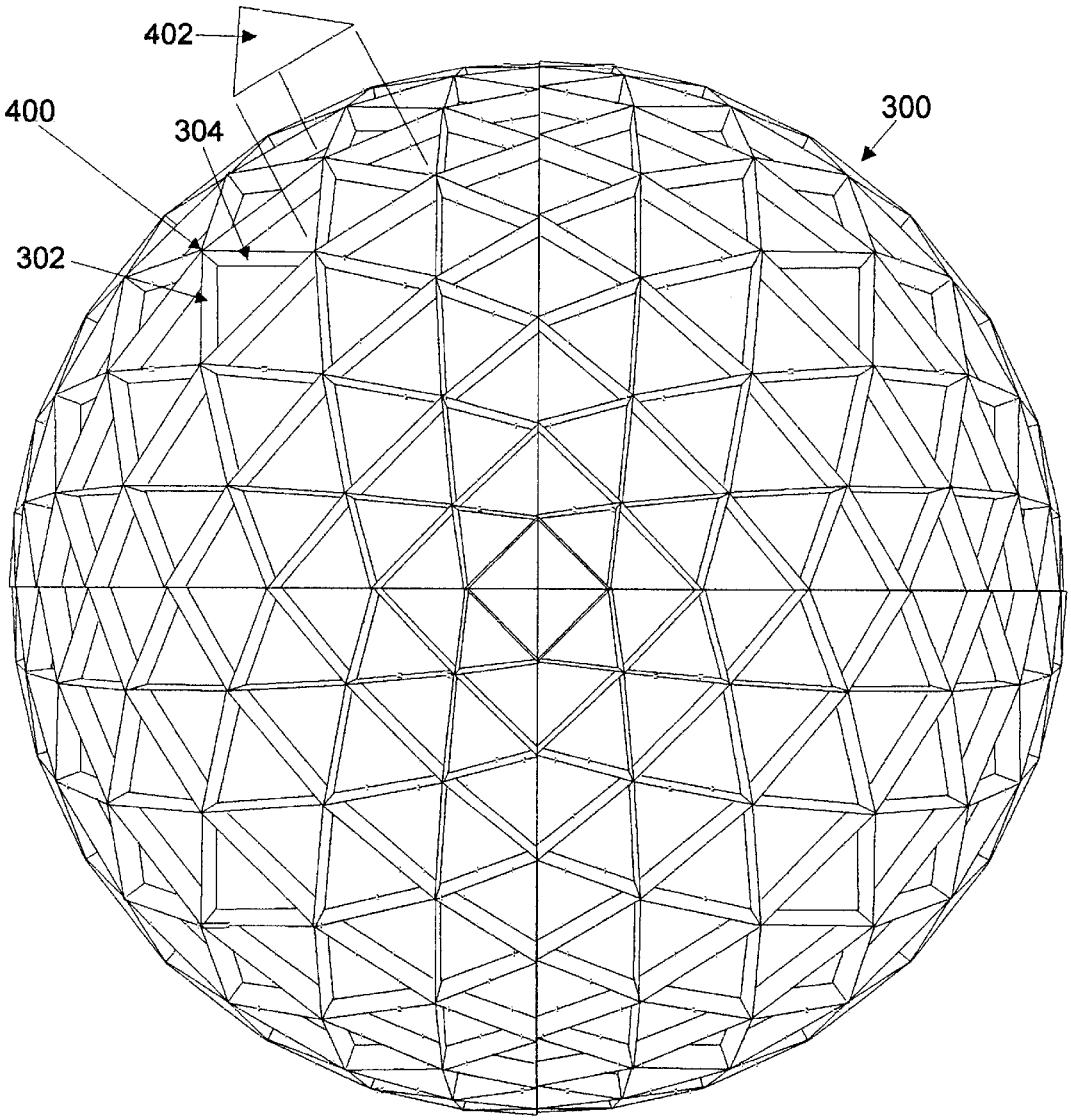
FIG. 6 is a perspective view of a first embodiment of a full geodesic dome created according to the method hereof.

As noted hereinabove, and as shown in FIG. 6, the substantially curved surface 10 is used as a pattern to construct a physical geodesic dome 300 from the mathematical model hereof. A plurality of components are fabricated for construction of the geodesic dome 300. In a first embodiment hereof, the components are a plurality of struts 302, 304, etc., with the plurality comprising at least as many struts as exterior lines are generated in the eighth step of the mathematical model hereof. The struts 302, 304, etc. are formed of any suitable material, such as aluminum, steel, a hard composite material, extruded hard plastic, wood, or the like. The lengths of the plurality of struts vary relative to each other, based on the relative lengths of the exterior lines generated in the eighth step of the mathematical model as detailed hereinabove. The dimensions of the struts other than length are not important, but should be substantially the same for all the struts, i.e. the struts should be substantially equally wide as each other and substantially equally high as each other. The struts may be straight or arcuate, at the option of the user, but the struts should either all be straight or all be arcuate, and if arcuate, the radius of curvature of all the struts should be equal.

Figure 10:
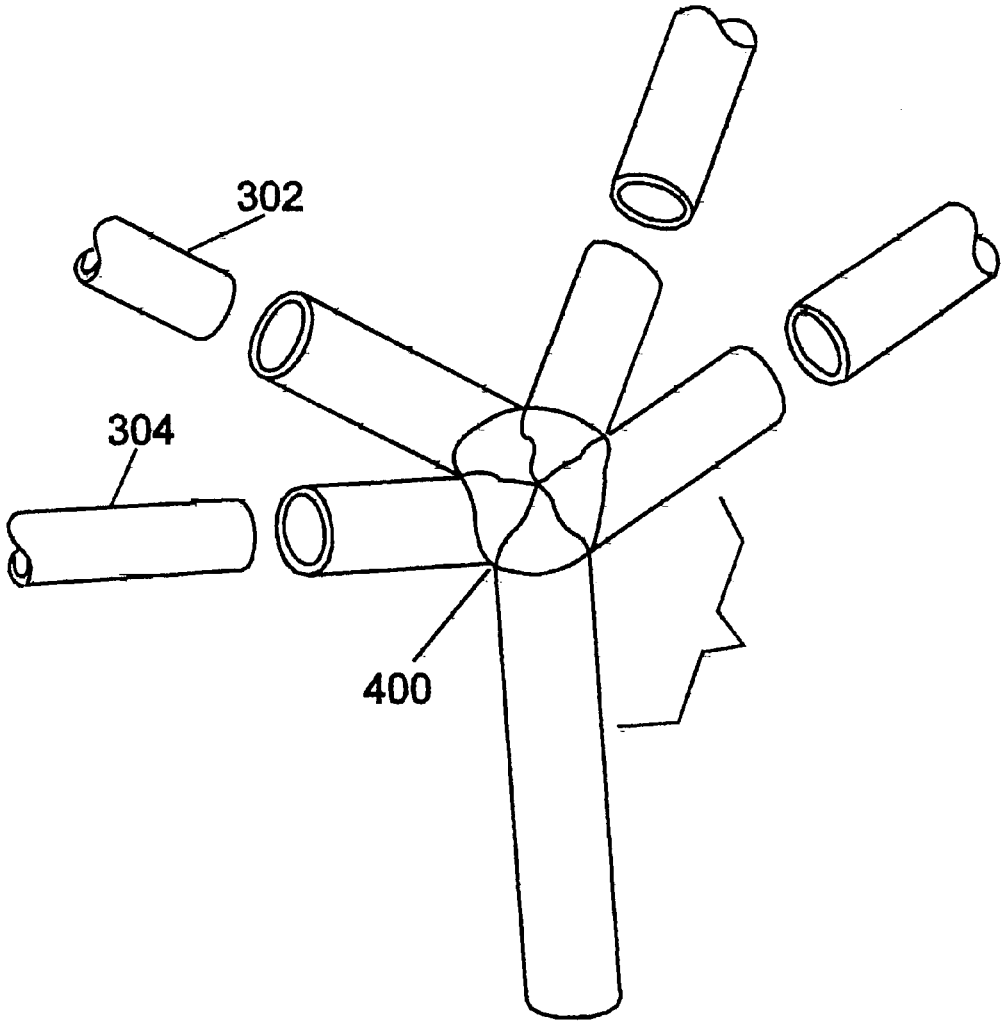
FIG. 10 is a perspective view of a means for fastening.

Any suitable means for fastening 400 is used to angularly fasten the struts together. Several such suitable means for fastening are disclosed in the prior art, as described below. One of these, the means for fastening used in U.S. Pat. No. 5,411,047, the disclosure of which is hereby incorporated by reference, is denoted, generally, at 400 in FIG. 10.

U.S. Pat. No. 2,682,235, the disclosure of which is hereby incorporated by reference, discloses the use of a ball-like fastener as a means for fastening. The ball-like fastener comprises two parts that are bolted together. A spring is incorporated therein to give a certain amount of resiliency in the fastening, which is particularly useful during construction of the structure. An attachment member secured to each end of each strut by rivets, bolts, or the like engages the ball-like fastener at any desired angle.

U.S. Pat. No. 2,914,074, the disclosure of which is hereby incorporated by reference, discloses the use of "hub-like members" as a means for fastening. As in the '235 patent, the construction components are struts.

U.S. Pat. No. 3,197,927, the disclosure of which is hereby incorporated by reference, discloses the use of tension rings as a means for fastening. The tension rings preferably are constructed with suitable tightening means such as flanges and bolts. The tension rings engage flanges on the construction components, which in the '927 patent are panels rather than struts. The '927 patent also discloses the use of flanged "manhole cover"-like fasteners in conjunction with the struts on the panels, with or without the tension rings.

U.S. Pat. No. 3,203,144, the disclosure of which is hereby incorporated by reference, discloses the use of adhesives to secure construction components to each other. The construction components are panels formed of spaced opposed sheets of paperboard, metal foil, plastic, or the like, with a core of expanded polystyrene foam between the sheets.

U.S. Pat. No. 4,719,726, the disclosure of which is hereby incorporated by reference, discloses the use of "hub or ball connectors or other suitable means" as a means for fastening. The construction components are struts.

U.S. Pat. No. 4,679,361, the disclosure of which is hereby incorporated by reference, does not disclose a means for fastening construction components together, nor does the patent disclose what construction components it contemplates using.

U.S. Pat. No. 4,723,382, the disclosure of which is incorporated by reference, discloses mating teeth; a combination of tongues and hollow tubes or rims; magnets; glue; nails; and screws as means for fastening. The construction components are either panels or struts.

U.S. Pat. No. 5,411,047, the disclosure of which is incorporated by reference, discloses a "universal fitting" which accommodates the individual support members in predetermined angular relationship. The universal fitting has a series of short tubes extending therefrom, each having an internal bore to accept a respective support member. The support members, or construction components, are struts.

As is seen from the above descriptions of the prior art, the exact means for fastening 400 is not important, and will probably vary among instances of the present invention in practice. As discussed in the prior art, flanges or other extensions of, or attachments to, the struts can be advantageously used in conjunction with various means for fastening. Further, the struts need not actually touch each other, as in the '047 patent which has all the struts at a given junction point entering a "universal fitting". If the struts do touch each other, though, the ends thereof must be angularly shaped to matingly engage each other in the pattern of the substantially curved surface hereof.

The struts 302, 304, etc. are fastened to each other in the same pattern as are the exterior lines generated in the eighth step of the mathematical model hereof, substituting one strut for each line generated in the eighth step, using the means for fastening 400 to fasten the struts to each other. Fastening the struts to each other in the pattern of the substantially curved surface 10 results in a framework of fastened struts in the shape of a physical geodesic dome 300 based on the mathematical model hereof, as shown in FIG. 6. The angles of the fastening will vary from intersection to intersection across the geodesic dome according to the angles in the model. Also, the angles of the fastening will vary from one geodesic dome to another as the frequency increases; as noted above, as the frequency increases, the more closely the geodesic dome approximates a sphere, with corresponding changes in angles between struts.

To aid in the manufacturing process, subparts of the geodesic dome, such as half geodesic domes, quarter geodesic domes, eighth geodesic domes, and the like, may be formed in the pattern of subparts of the substantially curved surface 10 by the process described hereinabove, and then the subparts of the geodesic dome fastened to each other by the means for fastening 400. An example of a model of such a subpart, a model of an eighth geodesic dome, is shown in FIG. 5. Similarly, if a subpart of a full geodesic dome is the desired end product for a particular user, only a portion of the substantially curved surface 10 would be used as the pattern in which to fasten the struts together.

Similarly, each subpart of a geodesic dome may be formed of fractional sections that are then fastened to each other to form the subpart, each fractional section being patterned after a portion of the substantially curved surface 10.

The exact number of subparts of the geodesic dome and/or fractional sections of each subpart is not important, nor is the order in which the subparts and/or fractional sections are fastened to each other, as long as the final pattern when all the subparts and fractional sections are joined together is the pattern of the curved surface 10. One such order of construction is to start with a first section that is to be furthest from the ground and add sections around the first section, thereby lifting the first section and, in effect, building the geodesic dome from the top down; another such order of construction is to start with a first section that is to be nearest the ground and add sections around the first section, thereby, in effect, building the geodesic dome from the bottom up. Many other orders of construction exist. As noted, the order of construction is-not important hereto.

A covering 402 made of any suitable material, such as plastic, glass, a composite material, or the like may be emplaced over or under the framework to cover same. The covering 402 is fastened to the framework by any suitable means, such as bolts or threaded fasteners, which may be the same as those used in the means for fastening 400; adhesives such as epoxies; or the like. For instance, the '235 patent discloses that the ball-like fastener used therein comprises a threaded fastener having an eyehook for securing a covering to the framework of struts. The means used to fasten the covering to the framework is dependent on the materials used for the covering and the struts; for instance, if both are made of a plastic, an epoxy adhesive could be used to fasten the covering to the struts. The covering 402 is meant to provide weatherproofing, acoustical benefits, etc.

Figure 7:
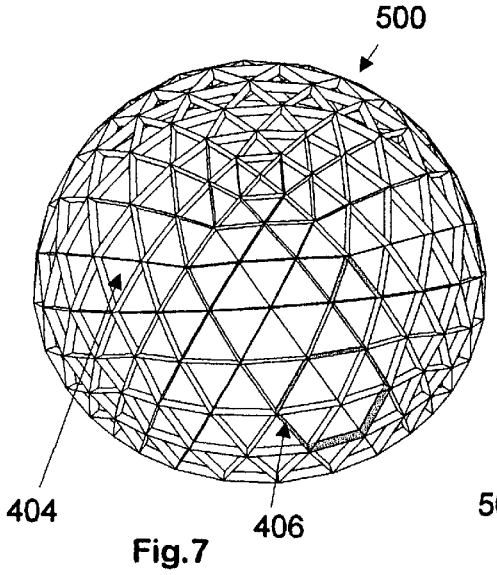
FIG. 7 is a perspective view of a second embodiment of a full geodesic dome created according to the method hereof.
Figure 8:
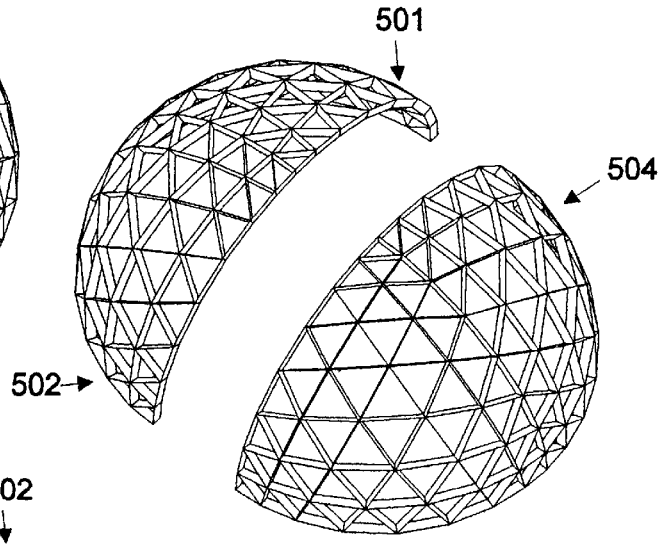
FIG. 8 is a partial perspective view of one half of the full geodesic dome of FIG. 7, the half divided into halves.
Figure 9:
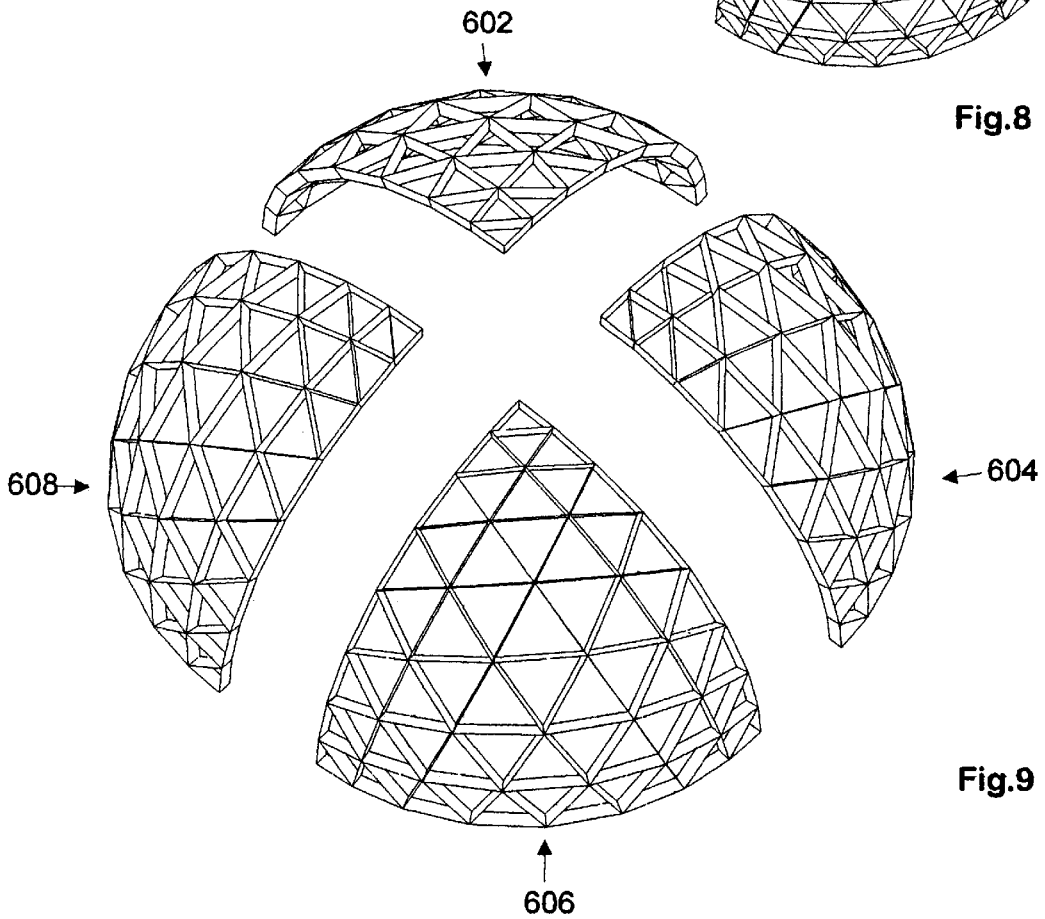
FIG. 9 is a partial perspective view of one half of the full geodesic dome of FIG. 7, the half divided into quarters.

In a second embodiment hereof, and as shown in FIGS. 7–9, the construction components are a plurality of panels rather than struts. The panels are fabricated and then angularly fastened together in the shape of the substantially curved surface 10 by the means for fastening 400, as discussed above with relation to the fastening of struts.

A geodesic dome 500 formed from panels is shown in FIG. 7. Each panel is shaped as a fraction of the substantially curved surface 10. The edges of the panels must be angularly shaped to matingly engage each other, as discussed above with relation to the angular edge requirements for struts. One example of panel formation is that each panel might be in the shape of one triangle of the substantially curved surface 10, as is denoted at 404 in FIG. 7; another example is that each panel might be in a hexagonal shape made of six triangles of the substantially curved surface 10, as is denoted at 406 in FIG. 8. Many other shapes of panels comprising combinations of triangles are possible. The panels need not be identically shaped from one to another, as long as they combine to form the geodesic dome of the model or a desired subpart thereof. The panels are formed of any suitable material, such as extruded plastic, a composite material, sheet metal such as aluminum, wood, glass, or the like. The panels may be planar or curved, at the option of the user, but the panels should either all be planar or all be curved, and if curved, the radius of curvature of all the panels should be equal.

If panels are used, a separate cover 402 is not needed, though one might still be desirable for weatherproofing, acoustics, etc. depending on the material used for the panels.

For both embodiments, it is anticipated that the end product desired by many users will be a portion of a full geodesic dome, such as a half geodesic dome. In this case, the framework or panels are, preferably, anchored to the ground or to a support structure by any suitable means, such as by one or more of the struts or panels being embedded in or bolted to a foundation (not shown) or the like.

Preferably, the number of base triangles is eight, i.e. M=8; the frequency is eight, i.e. N=8; the base triangles are equilateral triangles; and the three-dimensional shape is a regular octahedron. Thus, eight base equilateral triangles are generated in the first step; each leg of each base triangle is divided into eight segments with nine intersections in the fourth step; 64 smaller triangles per base triangle, with 45 total vertices per base triangle, are generated in the fifth step; the geodesic dome has 512 triangles on the surface thereof; etc. The higher the frequency is, the more closely the geodesic dome created by this method approximates a sphere. No absolute upper limit has been found for the frequency.

As noted, a geodesic dome based on a regular octahedron is desirable because a full geodesic dome based on a regular octahedron is easily divisible into half geodesic domes approximating hemispheres, as shown in FIG. 8 (only one half geodesic dome 501 being shown); quarter geodesic domes approximating quarter spheres, also as shown in FIG. 8 (only two quarter geodesic domes 502 and 504 being shown); eighth geodesic domes approximating eighth spheres, as shown in FIG. 9 (only four eighth geodesic domes 602, 604, 606, and 608 being shown); and other fractional sections.

It is contemplated that the method described herein can be used with a number of base triangles other than eight, although at least four base triangles are needed to define a closed three-dimensional figure. Using a number of base triangles other than eight is less preferred because the resultant geodesic dome is not easily divisible into halves, quarters, eighths, and other fractional sections, as described hereinabove. No absolute upper limit has been found for the number of base triangles.

It is further contemplated that the method described herein can be used with triangles other than equilateral triangles. Using non-equilateral triangles is less preferred because the resultant geodesic dome is not easily divisible into halves, quarters, eighths, and other fractional sections, as described hereinabove.

While the invention has been illustrated and described in detail in the drawings and the foregoing description, the same is to be considered as illustrative and not restrictive in character, it being understood that only the preferred embodiments have been shown and described fully and that all changes and modifications that come within the spirit of the invention are desired to be protected.

Having, thus, described the invention, what is claimed is:

1. A method of constructing a geodesic dome, the method comprising the steps of:

(a) generating a mathematical model of a geodesic dome, the method comprising the steps of:

(1) generating M base triangles in the form of a closed three-dimensional shape, each base triangle existing in a plane, M being a positive integer greater than three;

(2) defining a center point within the closed three-dimensional shape, the center point being equidistant from each of the vertices of each of the base triangles;

(3) defining a geodesic radius as the distance between the center point and any vertex of any of the base triangles;

(4) subdividing each leg of each of the base triangles into N segments of equal length, N being a positive integer greater than one, thus defining N+1 intersections along each leg of each of the base triangles;

(5) connecting each intersection defined in step (4) to two corresponding intersections within the same base triangle, thus generating $N^2$ smaller triangles within each base triangle;

(6) projecting an interior line between each vertex of each of the smaller triangles and the center point;

(7) extending each of the interior lines generated in step (6) through the plane of the base triangle in which the smaller triangle exists until each of the interior lines as extended outside the base triangle is the same length as the geodesic radius, each extended line terminating in an endpoint opposite the center point; and (8) connecting each exterior endpoint defined in step (7) to each other exterior endpoint generated in step (7) adjacent to the exterior endpoint by an exterior line, thus generating a substantially curved surface comprising $N^2*M$ triangles, the substantially curved surface defining a mathematical model of a geodesic dome;

(b) fabricating a plurality of components with which to form a geodesic dome according to the model; and (c) fastening the components to each other according to the model.

2. The method of claim 1 wherein the components are a plurality of struts, each of the plurality of struts corresponding to a respective exterior line generated in step (8).

3. The method of claim 1 wherein the base triangles are equilateral triangles.

4. The method of claim 1 wherein M=8.

5. The method of claim 3 wherein M=8.

6. The method of claim 1 wherein N=8.

7. The method of claim 5 wherein N=8.

8. A geodesic dome constructed according to the method of claim 1.

9. The geodesic dome of claim 8 further comprising:

a covering disposed upon the struts.

10. A geodesic dome constructed according to the method of claim 2.

11. The method of claim 1 wherein the components are a plurality of panels, each of the plurality of panels in the shape of a portion of the model.

12. A geodesic dome constructed according to the method of claim 11.

* * * * *